United States Patent [19]

Simpson

[11] Patent Number: 4,933,533

[45] Date of Patent: Jun. 12, 1990

[54] DEMISTING MIRROR

[75] Inventor: Barry Simpson, Craiglands, England

[73] Assignee: Sunbeam Corporation, Downers Grove, Ill.

[21] Appl. No.: 378,550

[22] Filed: Jul. 11, 1989

[30] Foreign Application Priority Data

Aug. 8, 1988 [GB] United Kingdom ..... 8818747

[51] Int. Cl.[5] ..... H05B 3/84

[52] U.S. Cl. ..... 219/219; 219/505; 219/345

[58] Field of Search ..... 219/213, 219, 345, 504, 219/505, 548, 549; 338/214; 350/588

[56] References Cited

U.S. PATENT DOCUMENTS

| | | | |
|---|---|---|---|
| 1,933,173 | 10/1933 | Hunt | 219/219 |
| 3,530,275 | 9/1970 | Rust | 219/345 |
| 3,564,207 | 2/1971 | Joeckel | 219/213 |
| 4,425,497 | 1/1984 | Leary | 219/345 |

*Primary Examiner*—Teresa J. Walberg

*Attorney, Agent, or Firm*—Neil M. Rose

[57] ABSTRACT

A mirror for domestic use in the bathroom or kitchen having electric heating means in the form of a resistance heater having a positive temperature coefficient of resistance and being an elongated cable supported by a molded plastic member in direct contact with the rear surface of the mirror.

14 Claims, 5 Drawing Sheets

DEMISTING MIRROR

FIELD OF THE INVENTION

This invention relates to a demisting system for a mirror and to a wall cabinet incorporating a mirror fitted with the demisting system.

BACKGROUND OF THE INVENTION AND PRIOR ART

When a mirror is situated in a hot, high humidity environment such as a bathroom or kitchen, it is particularly susceptible to the formation of a mist or condensed water on the exposed surface. This is due to the condensing action of the cold mirror surface on the steam or water vapor in the vicinity of the mirror resulting in condensation on the front surface of the mirror.

There have been examples of heated or demisting mirrors in the prior art, but none of the prior art approaches has been commercially successful because of their performance shortcomings. If a demisting mirror is to solve the problem facing the user in the bathroom in normal operating conditions, it must heat up quickly from a relatively cold condition, and it should not use an excessive amount of power. In addition, there are severe safety requirements because of the hazards of using electrical appliances in areas where the user is usually wet and well grounded, raising the risks of electrocution from any leakage currents associated with such appliances.

Examples of prior art anti-condensation mirrors are shown in the patents to Seibel, et al. U.S. Pat. No. 3,887,788; Seibel, et al. U.S. Pat. No. 3,839,620; Rust U.S. Pat. No. 3,530,275; and Catterson U.S. Pat. No. 3,160,736. The Seibel, et al. patents both disclose heating elements on printed circuit boards with various types of associated control means. The wattage limitations in the printed circuit board approach would make this impractical insofar as providing a heater which could bring the mirror up to the desired temperature in a relatively short time. Any printed circuit boards capable to providing relatively high wattage heat to the mirror would be relatively expensive, and the proper controls for any such arrangement would be difficult. In one embodiment of the Seibel, et al. U.S. Pat. No. 3,887,788 no temperature control is provided but it is acknowledged that it would be necessary to restrict the wattage and have a slow heat-up time with such an approach.

The patents to Rust and Catterson cited above are characterized by relatively complex arrangements of laminated glass and layers of insulation which support exposed resistance wire elements. It would be difficult to provide sufficient wattage for quick heat-up to elements of this design. The large thermal mass involved requires high wattage to attain the desired temperature for maintaining a mist free mirror and the exposed wire elements enclosed behind glass laminates would be hazardous in the event of glass breakage and from the standpoint of moisture possibly entering the area where the exposed resistance wire elements could be shorted or produce leakage currents.

There have been some examples in the prior art of heated mirrors for automobiles that have used positive coefficient resistance materials either as temperature control elements for constant resistance heaters or as heating elements. Noted in this connection are the U. S. patent to Berg, et al. U.S. Pat. No. 4,410,790 and the published European Patent Application No. 0054901.

BRIEF SUMMARY OF THE INVENTION

The present invention involves the use of a heating cable having conductors that are supported and separated by a carbon loaded polymer material having positive temperature coefficient resistance characteristics with self-limiting temperature characteristics. The conductors surrounded by the PTC material are enclosed in an insulating layer, making the heating cable safer than the exposed resistance wires of the prior art heated mirrors. Characteristic of PTC heating elements is the fact that the cold resistance is very low causing the element to draw very high currents initially, resulting in rapid heating of the mirror to a desired temperature at which the PTC material self limits and maintains the desired temperature for the mirror.

To improve the efficiency of the device, the heating cable is formed with many parallel adjacent lengths which traverse the rear surface of the mirror to provide uniform overall heating of the mirror. In addition, the mirror is supported by a molded plastic member having a base or heating element support which is spaced from and coextensive with the mirror. The base is formed with parallel ribs extending outwardly to form parallel channels within which the heater cable is received. The channels are of such a depth and the width of the heater cable dimensioned so that the heater cable is pressed against the rear face of the mirror improving the heat transfer between the heating cable and the mirror. The molded plastic member provides a substantial amount of thermal insulation, causing most of the heat generated in the heating cable to be transmitted directly to the mirror.

The parallel channels or slots in the support member for the heater cable are made wider than the thickness of the cable with a number of spaced protuberances being provided to support the heating cable at several places over the length of each of the parallel channels. This arrangement facilitates assembly of the heating cable to the plastic support member while at the same time maintaining the heater cable in proper position and orientation during and after assembly to the mirror.

The resulting heating mirror with the PTC heating cable and the one-piece molded plastic support provides an inexpensive and a highly efficient means for increasing the temperature of the mirror quickly to the level necessary to prevent condensation from forming on the mirror. Once the required temperature has been achieved, the heating cable self limits the temperature by substantially cutting off the current to the heating cable. This results in the elimination of any need for a secondary control and provides a heating means which under continuing use conditions uses very little power, only that necessary to maintain the desired temperature on the face of the mirror.

It is an object of the present invention to provide an improved anti-fogging or anti-condensation mirror for use in a humid environment with the heating means including a self-limiting PTC heater.

A further object of the present invention is to provide a heated mirror including a molded plastic member for supporting a PTC heating cable in intimate engagement with a mirror which is substantially coextensive with the molded plastic member.

It is a further object of the present invention to provide a heated mirror which has a tortuous PTC heating cable mounted in good thermal engagement with the mirror and having a self-limiting temperature of between 50° and 80° C.

It is further object of the present invention to provide a heated mirror which is supported by a molded plastic member having an elongated PTC heating cable sandwiched between the back of the mirror and the plastic member with the cable being received in a plurality of open parallel channels formed in said plastic member.

Further objects and advantages of the instant invention will become obvious to one skilled in the art as the following description proceeds, and the features of novelty which characterize the invention will be pointed out in the claims annexed to and forming a part of the specification.

BRIEF DESCRIPTION OF THE DRAWINGS

As shown in FIGS. 1, 2 and 3, there is supported on the front of member 11 a mirror 13 which may be made of glass coated on the rear surface with a reflecting material as is well known in the art.

Figure 1:
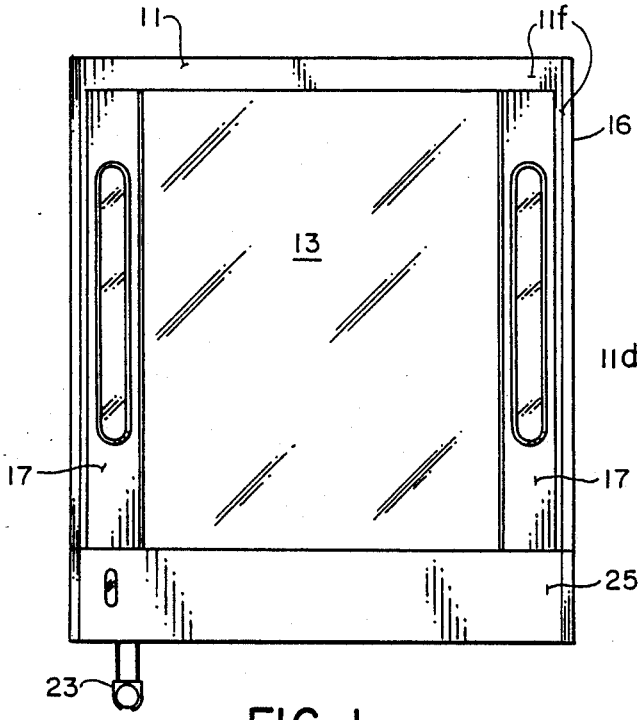
FIG. 1 is a front elevation of the preferred embodiment of the demisting mirror of the present invention.
Figure 2A:
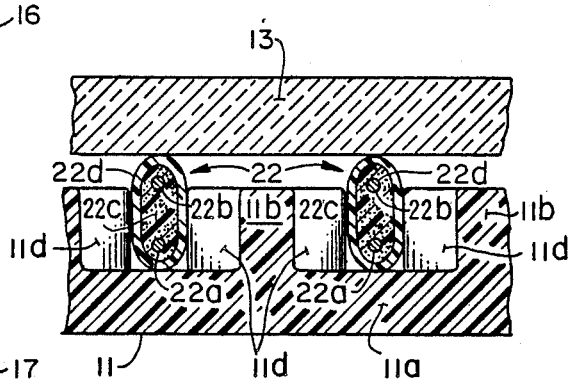
FIG. 2*a* is an enlarged cross sectional view of the heating cable included in the demisting mirror of FIGS. 1 and 2.
Figure 2:
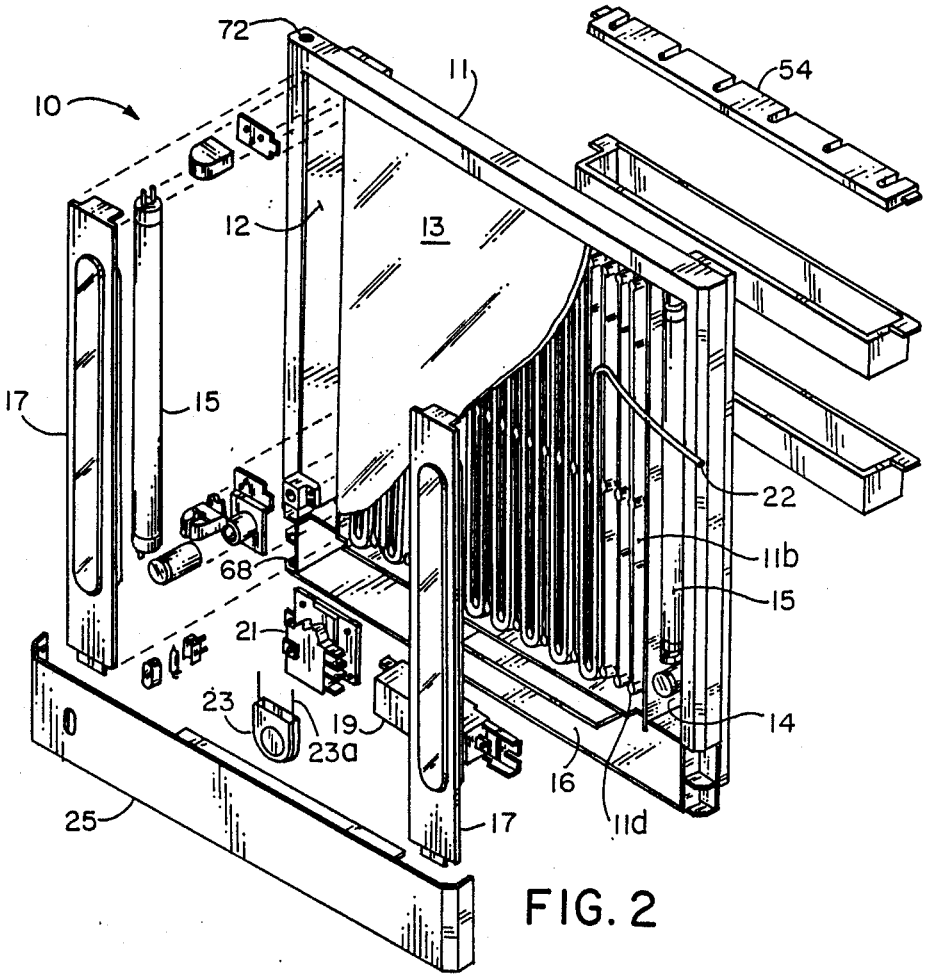
FIG. 2 is an exploded perspective of the demisting mirror of FIG. 1.
Figure 3:
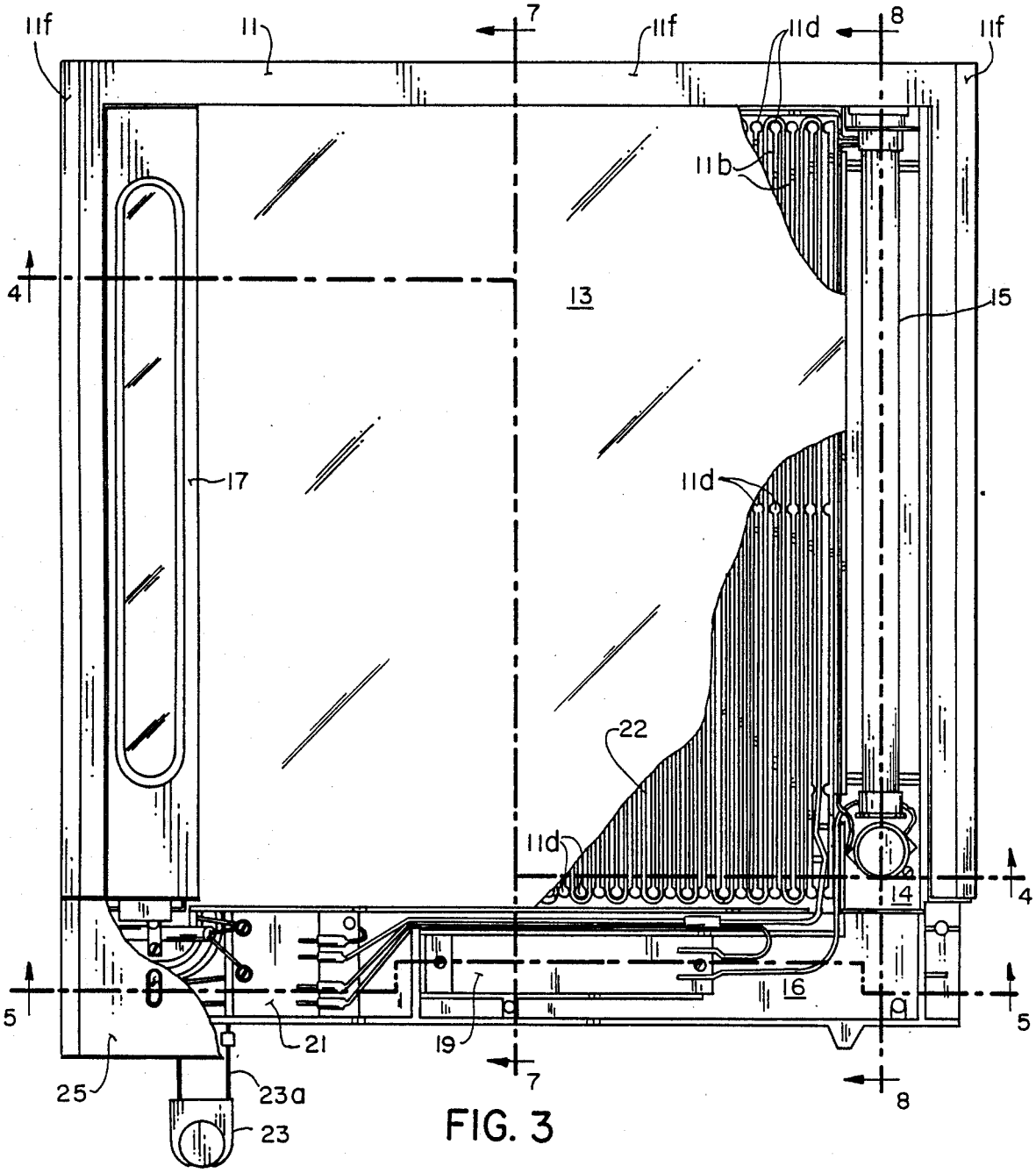
FIG. 3 is a front elevation of the demisting mirror of FIG. 1 with portions of the front cover and the mirror removed.
Figure 4:
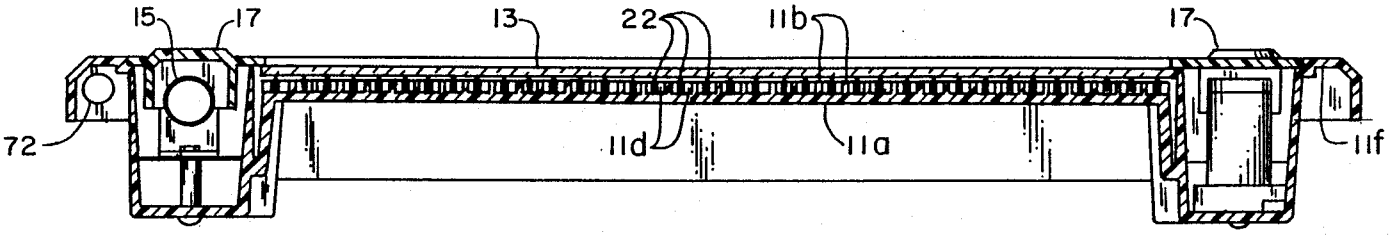
FIG. 4 is an enlarged sectional view taken along line 4—4 of FIG. 3.

Alongside and below the mirror 13, the support member 11 is formed with forwardly facing recesses or compartments 12, 14 and 16, as best shown in FIGS. 2 and 3. Received within the compartments 12 and 14 are fluorescent lights 15. Translucent covers or lenses 17 are mounted on the support member 11 to close the compartments 12 and 14 enclosing the lights 15 therein and serving to transmit the illumination from the lights 15 to the face of the person standing before the mirror 13. The compartment 16 extending below the mirror 13 receives the electrical components, such as ballast 19 for the fluorescent lamps, a switch 21 and switch actuator 23. The compartment 16 is closed by a cover 25 which is secured by screws, not shown, to the support member 11.

The housing 10 may be mounted on a suitable support such as a wall by, for example, attachment means such as screws, not shown, extending through apertures 20 provided in the base of compartments 12 and 14 and into a vertical wall or other support.

The portion of the support member 11 which is coextensive with the mirror 13 includes a flat plate-like portion 11*a* which has a rectangular shape corresponding to that of the mirror 13. A plurality of parallel spaced ribs 11*b* are formed on the support member 11 extending outwardly from the portion 11*a* toward the mirror. The ribs 11*b* define channels within which an elongated heating cable 22 is received. As shown in the cross sectional showing of FIG. 2*a*, the heating cable 22 consists of a pair of spaced conductors 22*a* and 22*b* which are enclosed in an envelope of extruded positive temperature resistance material 22*c*. The envelope of PTC material 22*c* is enclosed by an extruded coating of electrically insulating material 22*d*. The PTC material is preferably a carbon loaded polymer as disclosed in the U. S. Pat. No. 4,277,673 to Kelly. The PTC material 22*c* may be formulated to have suitable cut-off characteristics so that the resistance increases to such a level that, at a desired maximum temperature of the mirror it self limits the heating of the mirror 13 as will be explained below.

Figure 7:
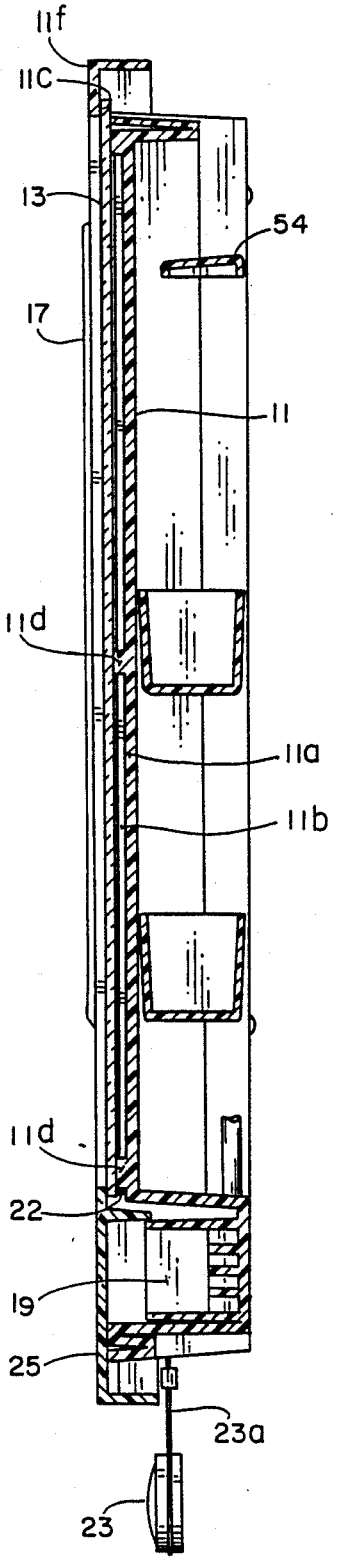
FIG. 7 is an enlarged longitudinal sectional view taken along the line 6—6 of FIG. 3.
Figure 8:
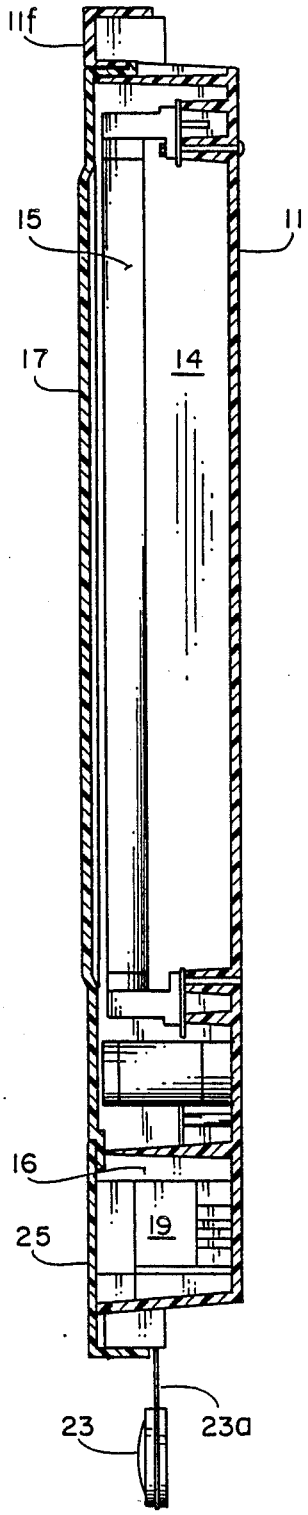
FIG. 8 is an enlarged longitudinal sectional view taken along the line 8—8 of FIG. 3.

The arrangement of ribs 11*b* is preferably such that the PTC heating cable 22 extends substantially uniformly over the entire area of the support member 11 that is to be covered by a mirror 13, in practice over substantially the entire area of the plate-like portion 11*a*. The mirror 13 is disposed over the portion 11*a* and preferably in substantially uniform, intimate, contact with the PTC heating cable. The top edge of the mirror is received under the edge 11*c* of the support member 11 which edge is best shown in FIG. 7. The lower edge of the mirror is engaged by a cover 25 which closes the compartment 16 and which overlaps the lower edge of the mirror 13.

As is best shown in FIG. 3, the ribs 11*b* are formed at the ends and at their midpoints with cylindrical post-like portions 11*d* which result in the channels formed between the ribs 11*b* being narrower at the ends and midpoints where the portions 11*d* are located. The portions 11*d* may be formed as the member 11 is molded or may be formed after the molding by heat deforming the ribs 11*b* at their ends and midpoint, producing the portions 11*d* which may comprise somewhat flattened portions of the ribs 11*b*. At their narrow portions the channels have a width slightly wider than the thickness of the heating cable 22. The heating cable 22 is mounted within the channels with thickness of the cable positioned between the portions 11*d* so the cable may be described as standing on edge in the channels so that it protrudes slightly forward of the ribs 11*b*, as shown in FIG. 2A. By so arranging the cable 22, the mirror 13 engages the heater cable 22 directly, thereby improving the heat transfer to the mirror 13. The portions 11*d* not only retain the heater cable 22 on edge but also prevent the cable 22 from being bent too sharply or in too small a radius as it is wrapped around the end of each rib 11*b* where the adjacent parallel legs of the cable 22 are connected.

One end of the PTC cable 22 extends from the portion 11*a* of support member 11 into compartment 16 where it is connected to a switch 21 for controlling the supply of electric power for the PTC heater cable. The compartment 16 also contains other electrical components including ballast 19. As illustrated, the compartment 16 is located at the lower edge of the mirror. This is preferred because the weight of the components mounted in the compartment 16 would make the assembly less stable if the compartment 16 were located at one or other side edge or along the top.

The switch 21 in compartment 16 is controlled by an actuator 23 which is connected to the switch 21 by a chain or cord 23*a*. In operation, the PTC cable 22 is energized by pulling the actuator 23. The PTC heating cable 22 includes the two conductors 22*a* and 22*b* over which is extruded the PTC coating 22*c*. This PTC coating is in turn coated with an insulating coating 22*d* such as P.V.C. In a preferred embodiment constructed in accordance with the invention, the properties of the heating cable 22 are such that when energized it will rapidly rise to a predetermined temperature, for example, of the order of 67° C. to 70° C., whereupon the temperature of the cable will remain substantially constant. The cable will draw current so as to remain at this predetermined temperature and the current demand will depend on ambient temperature. Thus, an ambient temperature drop will result in more current being drawn from the power means as more current will be needed to heat the cable. On the other hand, a rise in ambient temperature will result in less current being drawn from the power means in order to maintain the desired cable temperature and thus heating effect of the cable on the mirror 13 substantially constant. As the wire is in substantially uniform intimate contact with the rear surface of the mirror 13, the heat of the cable 22 will be transferred to the front surface of the mirror 13 which will prevent condensation thereon.

It is desirable to maintain the temperature of the outer face of the mirror 13 at a high enough temperature to eliminate condensation while keeping the temperature low enough to avoid burning the user through accidental contact with the mirror and to minimize the power consumed by the mirror. It would be desirable to have the exposed surface of the mirror between 38° C. and 55° C. In the constructed embodiment, the heating cable temperature of 67° C. to 70° C. resulted in a mirror temperature of from 43° C. to 49° C., the heat transfer and heat loss accounting for the lower temperature on the mirror face as compared to the temperature of the heating element itself.

In the above described embodiment of the invention, the heating cable 22 was approximately 45 feet in length and generated one and one half watts per foot at 38° C. When the cable 22 was initially energized, it generated on the order of five watts per foot which produced the rapid heat-up of the mirror from room temperature to the temperature at which the cable 22 self limits in temperature. In accordance with the invention, it is preferable that the elongated heating cable 22 deliver one to three watts per foot and that its power at room temperature be three to four times the power at 38° C.

An added advantage of utilizing PTC wire in this invention is in its speed of attaining the desired temperature. The temperature of the wire should reach the desired level within approximately five minutes. This will, therefore, result in quick demisting of the mirror if it has already misted up and will prevent misting up if that has not yet occurred. Thus, if the PTC cable 22 is energized before causing an increase in humidity by, for example, filling a bath tub with hot water in the vicinity of the mirror, then misting will be prevented.

The time taken to heat the mirror will obviously vary as a function of the mirror thickness as well as the wattage of the cable 22. In this respect thin mirrors are desirable. However, if the mirror is substantially less than three millimeters thick, the strength of the mirror 13 will be impaired. In addition, a thin mirror may flex even if only twelve inches by fifteen inches, and, therefore, it may not be possible to hold it in contact with the PTC cable over its whole area. Where there is no contact, or poor contact, between the mirror and the PTC cable the heat transfer to the mirror at that location may not be sufficient to prevent localized misting or condensation. If the mirror is too thick then the heat transfer from the rear of the mirror to the front will take longer. A mirror thickness in the range from substantially two to four millimeters is preferred, a mirror thickness of substantially three millimeters being ideal for a normal size bathroom mirror.

In the preferred embodiment of the invention fluorescent tube lights 15 are provided within compartments 12 and 14. The removable covers 17 of, for example, plastics or glass material, close the compartments 12 and 14. The cover 25 may be textured around its periphery so as to conceal any electrical components in the housing which would otherwise be visible. The portion of cover or lenses 17 which is directly above the fluorescent tube 15 is adapted to provide maximum illumination. The covers 17 are preferably fixed to the support member 11 by removable clips so as to permit access to the compartments 12 and 14 for maintenance purposes such as replacement of the tubes 15.

Figure 9:
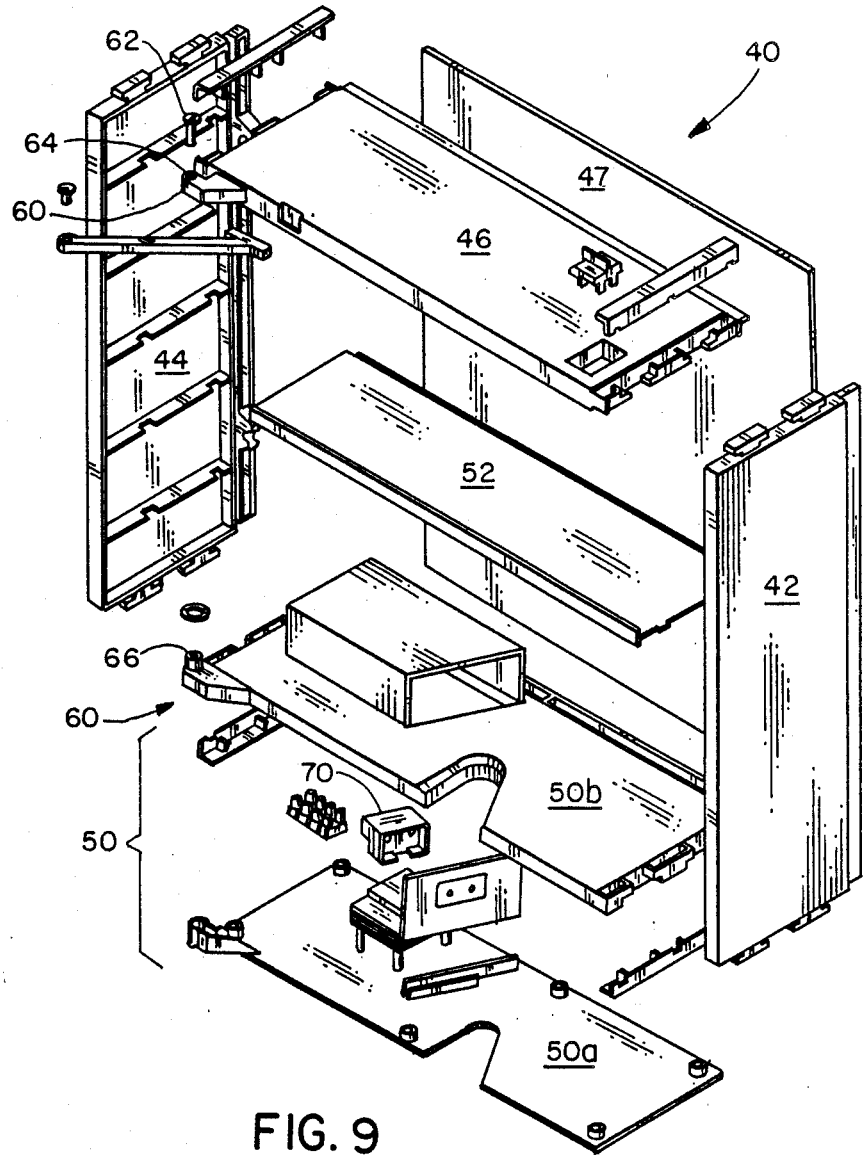
FIG. 9 is an exploded perspective view of a cabinet for supporting the mirror of FIG. 1; and Referring to FIGS. 1 and 2 of the drawings, there is shown a demisting mirror or mirror housing designated generally by reference numeral 10. The demisting mirror 10 includes a large generally planar support member 11 which is preferably formed of molded plastic.

The apparatus of the invention as hereinbefore described can form a door mounted, for example, on the front of a cabinet. An application of this kind is understood from FIG. 9 in which the demisting mirror 10 of the invention may be mounted at the front of a cabinet 40, the mirror 10 being rotatable about a hinge mechanism 60.

The cabinet 40 comprises side panels 42, 44, an upper panel 46, a rear panel 47 and a base 50 comprising base pieces 50*a*, 50*b*. The cabinet parts may be manufactured from plastics material for example. The base pieces 50*a* and 50*b* are of a corresponding shape such that they may be joined together to form the base 50. This arrangement of the base panel 50 facilitates inclusion of a shaver socket 70 mounted thereon. The associated electrical wiring for the socket 70 can be passed between base pieces 50*a* and 50*b* and, therefore, not be visible. If an electrical device is not present in the cabinet, the base panel 50 may be formed from a single piece. The cabinet may include for example shelves 52. Toothbrush racks 54 or the like may be mounted on the rear of mirror housing 10 as shown in FIG. 2.

Figure 5:
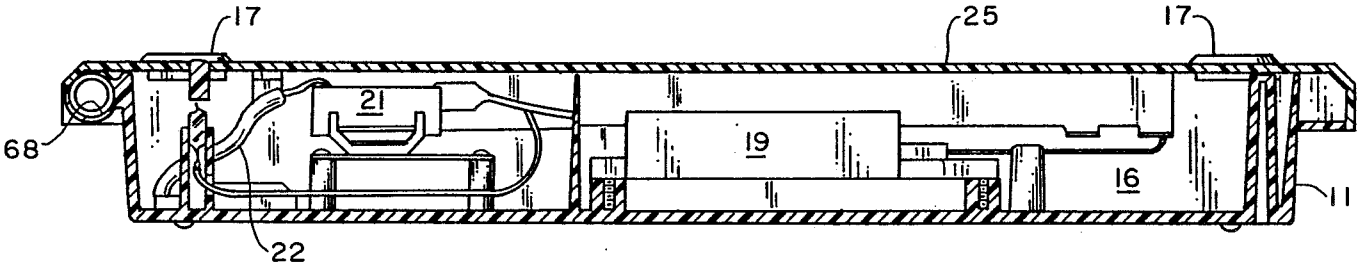
FIG. 5 is an enlarged sectional view taken along line 5—5 of FIG. 3.
Figure 6:
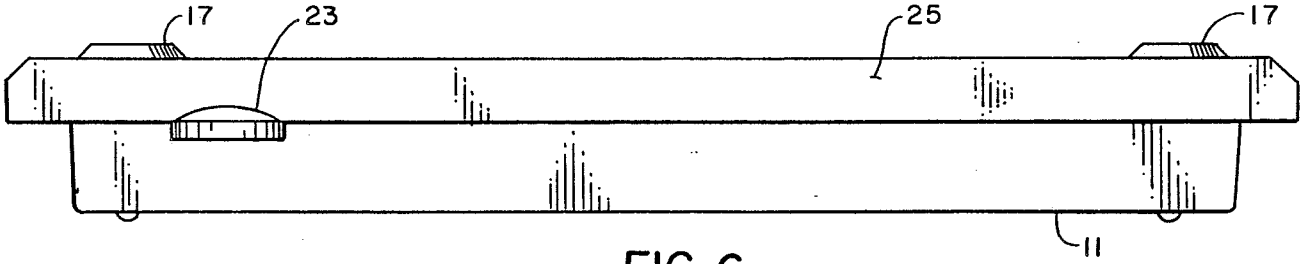
FIG. 6 is an enlarged bottom plan view of the mirror shown in FIG. 3.

The hinge mechanism 60 to mount the mirror 10 with respect to cabinet 40 comprises a simple pin connection between openings on the support member 11 and the cabinet 40. In the illustrated embodiment of the invention the upper hinge mechanism comprises a pin 62 which is passed through an aperture 64 in the upper panel 46 and subsequently through an aperture 72 in support member 11. The lower hinge mechanism comprises a cylindrical hinge projection 66 which passes through an aperture 68 in the support member 11, as shown in FIGS. 2 and 5. The side panels 42, 44, upper panel 46 and base panel 50 are joined together by connecting means, such as mortise and tenon joints. The electrical connections to the mirror 10 extend from the base panel 50 through the hinge projection 66 into the compartment 16 to switch 21.

From the foregoing, it may be understood that the demisting mirror 10 may be wall mounted by screws extending through openings in the support member 11 or it may be hingeably connected to the cabinet 40 forming the door or closure for the cabinet 40.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An electrically heated mirror with means for preventing condensation comprising a generally planar reflecting member, having a front facing surface and rear mounting surface, support means for said member being substantially coextensive with said reflecting member, an elongated heating cable having spaced conductors supported and separated by a heating media which is a conductive polymer having a positive temperature coefficient of resistance, an electrically insulating coating surround said conductors and said heating media, means for applying a voltage across said conductors to heat said cable by passing a current through said heating media, said cable heating said member to a temperature above ambient temperature to prevent condensation on said front facing surface, said heating media self limiting the temperature of said member to a temperature at which the user will not be burned on touching said member, said heating cable being arranged in a tortuous configuration and mounted in contact with the mounting surface of said reflecting member to heat said reflecting member to a uniform temperature across its entire surface area.

2. The electrically heated mirror of claim 1 wherein said heating cable is positioned between said support means and said reflecting member with said heating cable being in continuous engagement with said rear mounting surface of said reflecting member.

3. The electrically heated mirror of claim 2 wherein said heating cable is disposed against said reflecting member with a plurality of parallel closely spaced lengths of cable which traverse said member and occupy substantially the entire rear mounting surface of said member.

4. The electrically heated mirror of claim 3 wherein said heating cable generates less than three watts per foot at 38° C.

5. The electrically heated mirror of claim 2 wherein said heating cable has a cross section in which the thickness of the cable in a direction normal to the plane of the conductors is less than the width of the cable in the direction between the conductors, the heating cable being mounted on edge between said support means and said reflecting member with said cable being sandwiched therebetween across its said width.

6. The electrically heated mirror of claim 5 wherein said support member is a molded plastic piece having channels formed therein which open toward said reflecting member and receive said heating cable, the portions of said support member defining said channels engaging said heating cable to support said cable on edge.

7. The electrically heated mirror of claim 6 wherein said heating cable self limits to maintain the temperature of said reflecting member to between 38° C. and 55° C.

8. The electrically heated mirror of claim 6 wherein said channels in said support member are parallel and extend entirely across said reflecting member to heat said reflecting member to a uniform temperature, said channels being defined by ribs which are spaced apart by a distance substantially greater than the thickness of said cable, enlargements formed in said ribs at the ends and intermediate the ends to form narrowed portions in said channels to engage said cable and support said cable in said on edge position.

9. The electrically heated mirror of claim 1 wherein said support means includes integrally formed compartments, positioned adjacent to said reflecting member, illumination means mounted in each of said compartments for directing light in front of said mirror.

10. The electrically heated mirror of claim 1 wherein said heating cable self limits to maintain the temperature of said reflecting member to between 38° C. and 55° C.

11. An electrically heated mirror with means for preventing condensation comprising a generally planar mirror having a front facing surface and rear surface coated with a reflecting layer, a support member for said mirror having a planar portion which is substantially coextensive with said mirror, said support member having integrally formed compartments which extend laterally from said planar portion to provide forwardly facing elongated recesses on opposite sides of said mirror, said planar portion being formed with a plurality of parallel channels which extend across said planar portion and which face toward said rear surface of said mirror, an elongated heating cable having spaced conductors supported and separated by a heating media which is a polymer mixture having a positive temperature coefficient of resistance, means applying a voltage across said conductors to heat said cable by passing a current through said heating media which self limits the temperature of said cable to a range of between 50° C. and 80° C., said heating cable being mounted in said parallel channels in contact with said reflecting layer of said mirror to heat said mirror to a uniform temperature across its entire surface area.

12. The electrically heated mirror of claim 11 wherein said channels in said support member are parallel and extend entirely across said reflecting member to heat said reflecting member to a uniform temperature, said channels being defined by ribs which are spaced apart by a distance substantially greater than the thickness of said cable, enlargements formed in said ribs at the ends and intermediate the ends to form narrowed portions in said channels to engage said cable and support said cable in said on edge position.

13. An electrically heated mirror with means for preventing condensation comprising a generally planar reflecting member, having a front facing surface and rear mounting surface, an elongated heating cable having spaced conductors supported and separated by a heating media which is a conductive polymer having a positive temperature coefficient of resistance, an electrically insulating coating surround said conductors and said heating media, means for applying a voltage across said conductors to heat said cable by passing a current through said heating media, said cable heating said member to a temperature above ambient temperature to prevent condensation on said front facing surface, said heating media having a low ambient temperature resistance to heat said member rapidly and self limiting the temperature of said member to a temperature above ambient temperature at which the user will not be burned on touching said member, said heating cable being mounted in contact with the mounting surface of said reflecting member to heat said reflecting member.

14. The electrically heated mirror of claim 13 wherein said heating cable is on the order of forty five feet long and generates from one to three watts per foot at 38° C., said heating cable being disposed against said reflecting member with a plurality of parallel closely spaced lengths of cable which traverse said member and occupy substantially the entire rear mounting surface of said member.

* * * * *